United States Patent [19]

Bongartz et al.

[11] 4,060,223

[45] Nov. 29, 1977

[54] DEVICE FOR MIXING GRANULAR AND/OR PULVEROUS SUBSTANCES

[75] Inventors: Paul Bongartz, Isny-Kleinhaslach; Franz Haag, Isny, both of Germany

[73] Assignee: Motan Gesellschaft mit beschrankter Haftung, Isny, Germany

[21] Appl. No.: 715,046

[22] Filed: Aug. 17, 1976

[30] Foreign Application Priority Data

Oct. 4, 1975 Germany ..... 2544441

[51] Int. Cl.[2] ..... B01F 15/00

[52] U.S. Cl. ..... 366/179; 137/625.44

[58] Field of Search ..... 259/4 R, 4 A, 4 AB, 259/4 AC, 18, 36; 137/625.44, 625.45, 625.4

[56] References Cited

U.S. PATENT DOCUMENTS

| | | | |
|---|---|---|---|
| 820,740 | 5/1906 | Schmidt | 137/625.44 |
| 1,927,947 | 9/1933 | Newell | 259/4 AB |
| 2,999,640 | 9/1961 | Waterfill | 137/625.44 X |
| 3,047,275 | 7/1962 | Cox | 259/4 R |
| 3,164,376 | 1/1965 | Clark | 259/4 R |
| 3,317,191 | 5/1967 | Brown | 259/4 R |
| 3,667,732 | 6/1972 | Lejeune | 259/4 R |
| 3,707,829 | 1/1973 | Siegel | 259/18 X |

*Primary Examiner*—Edward J. McCarthy
*Attorney, Agent, or Firm*—Walter Becker

[57] ABSTRACT

A mixing device for mixing flowable materials, especially dry materials, such as pulverant or powdered materials, in which a pair of inlet conduits have the downstream ends connected to a fitting which is also connected to the upstream end of a discharge conduit with a valve for selectively controlling the downstream ends of the supply conduits. Separate supply chambers are connected to the upstream ends of the supply conduits and charge a respective material into the associated supply conduit in conformity with the setting of the flap valve.

A secondary mixing device is connected to receive mixed material in the discharge conduit for further mixing of the material while air may also be extracted from the material.

20 Claims, 6 Drawing Figures

DEVICE FOR MIXING GRANULAR AND/OR PULVEROUS SUBSTANCES

The present invention relates to a device for mixing granulates and/or pulverous substances, for instance granulates of synthetic material, dye powder, and the like. Devices of this general type have become known. Heretofore mixing devices for granulates and/or pulverous substances contained a drum which is rotatably mounted in a housing and which mixes the substances which are introduced into the drum through separate inlets. After the mixing has been effected, the mixed material is discharged at the bottom of the housing through an opened flap. Devices of this type operate at a relatively low speed and have to be cleaned in relatively short intervals to assure a proper intermixing.

It is, therefore, an object of the present invention to provide a device of the above described general character which will afford a higher throughput and which will require a minimum of service.

This object and other objects and advantages of the invention will appear more clearly from the following specification in connection with the accompanying drawings, in which:

FIG. 1*a* diagrammatically illustrates a mixing device according to the invention which operates under pressure.

FIG. 1*b* diagrammatically illustrates a mixing device according to the invention which operates under suction.

The device for mixing granulates and/or pulverous substances with each other in conformity with the present invention is characterized primarily by at least two inlet passages which lead to the same inlet spot and which are adapted to be charged with the materials to be intermixed. The device according to the invention is furthermore characterized by an outlet passage starting at the mentioned inlet spot. Further the device according to the present invention comprises a device adapted to be controlled for alternately blocking one of the inlet passages.

Figure 1A:
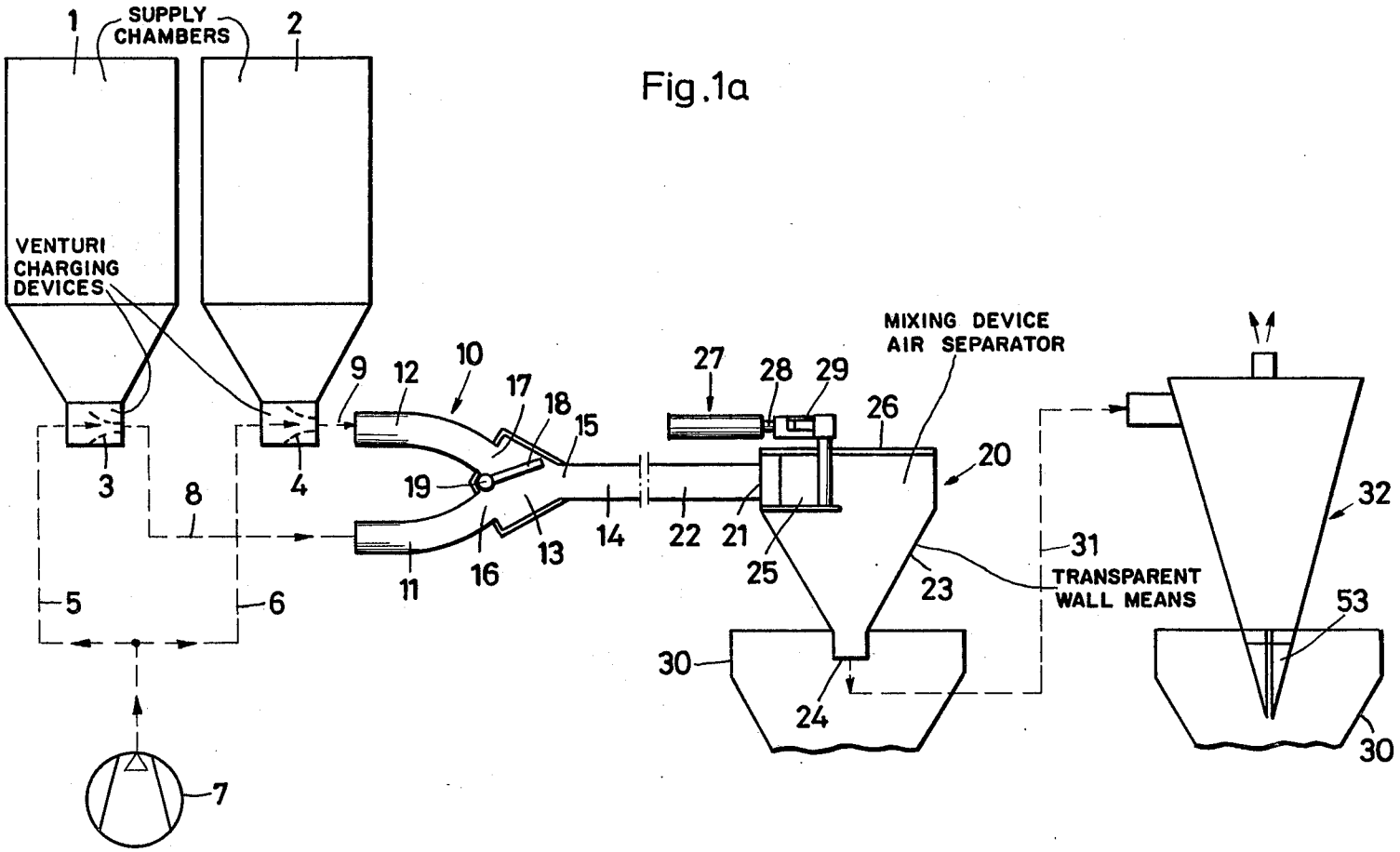

Referring now to the drawings in detail, the mixing device shown in FIG. 1*a* comprises two supply containers 1, 2 for the substances to be intermixed, for instance, a fresh granulate of synthetic material and a regenerated granulate of synthetic material. At the bottom side of the supply containers 1, 2 there are respectively provided injectors 3, 4 which through an associated pressure line 5, 6 respectively are connected to a compressed air blower 7. The outlets of the injectors 3 and 4 are through the intervention of diagrammatically illustrated feeding lines connected to inlet passages 11 and 12 respectively of a mixing device 10. The two inlet passages 11 and 12 lead to a common spot in a connecting chamber 13 from which a discharge passage 14 leads to an outlet. The outlet opening 15 of passage 14 is located substantially opposite the mouths 16 and 17 of the inlet passages 11 and 12 respectively. The mouths 16, 17 are adapted to be alternately closed by means of a controllable flap 18 which is pivotable about the axis 19 which is located perpendicular to the drawing plane of FIG. 1*a*. The axis 19 is located in the vicinity of the contacting areas of the two inlet passages 11 and 12.

The outlet passage 4 is connected in an air-tight manner with the inlet opening 21 of the second mixing device 20 through the intervention of a flexible coupling member 22, for instance of rubber. The second mixing device 20 comprises a funnel-shaped housing 23 the top side of which has provided thereon preferably the tangential inlet opening 21 and at the bottom side of which has an axial outlet opening 24. Within the region of the inlet opening 21 there is provided a controllable guiding device in the form of a flap 25 by means of which the centrifugal acceleration of the substances to be mixed is adjustable which substances enter housing 23 through the opening 21. The flap 25 is journalled on the cover 26 of housing 23 so as to be pivotable about a vertical pin located in the drawing plane of FIG. 1*a*. The pivot pin of flap 25 is engaged by a hydraulic adjusting device 27 by means of its hydraulic piston 28 and a lever arm 29.

The mixing device 20 may be so designed that it additionally has the function of an air separator for removing the air contained in the mizing substances. In this instance the outlet opening 24 of housing 23 leads directly into a charging funnel 30 which is only partially shown and which pertains to a non-illustrated processing machine for the mixed materials, for instance, a synthetic material injection molding machine. If the mixing device 20 has no air separating function as is diagrammatically shown in FIG. 1*a*, the exit opening 24 communicates through a conduit 31 with an air separator 32 the outlet opening 53 of which leads into the charging funnel 30 of the processing machine.

The operation of the mixing device shown in FIG. 1*a* is as follows: The compressed air stream (indicated by short arrows) generated by the compressed air blower 7 selectively, in conformity with the position of flap 18 of the mixing device 10, conveys the granulate present in the storage container 1 or 2 to the outlet passage 14 of the mixing device 10. Due to a periodic shifting of flap 18, a successive charging of the outlet passage 14 is effected with the two substances stored in the storage containers 1 and 2 whereby the intermixing is effected up to a certain extent. The flexible coupling member 22 between the outlet passage 14 and the inlet opening 21 of the second mixing device 20 will, in view of its expandability, permit a storage of the mixed materials formed in the outlet passage 14 whereby an asynchronous operation of the mixing devices 10 and 20, i.e., an asynchronous shifting of the flaps 18 and 25, or, expressed differently, a running ahead or trailing, of one mixing device relative to the other mixing device will be possible. The mixing substance which subsequently through opening 21 enters the second mixing device 20 is there, depending on the position of flap 25, subjected to a different centrifugal acceleration. In this connection a periodic shifting of the flap 25 brings about that in one position of flap 25 the entering mixing charge will be distributed over the entire inner surface of housing 23 in a uniform manner in the form of a thin film whereas in the second position of flap 25, the entering mixing charge will be deviated more toward the center of the housing 23. In this position the last mentioned mixing charge will in the lower region of housing 23 be superimposed in the form of a further thin film upon the previously formed film and will mix therewith. As a result thereof, the mixing charges successively entering the mixing device 20 move within the housing 23 like two bands of film parallel to each other whereby a uniform intermixing of the materials to be intermixed and thus of the two granulates will be assured. From the thus formed mixture the air contained therein is withdrawn either within the second mixing device 20 or by means of a following separator 32, whereupon the mixture is conveyed to the charging funnel 30.

Figure 1B:
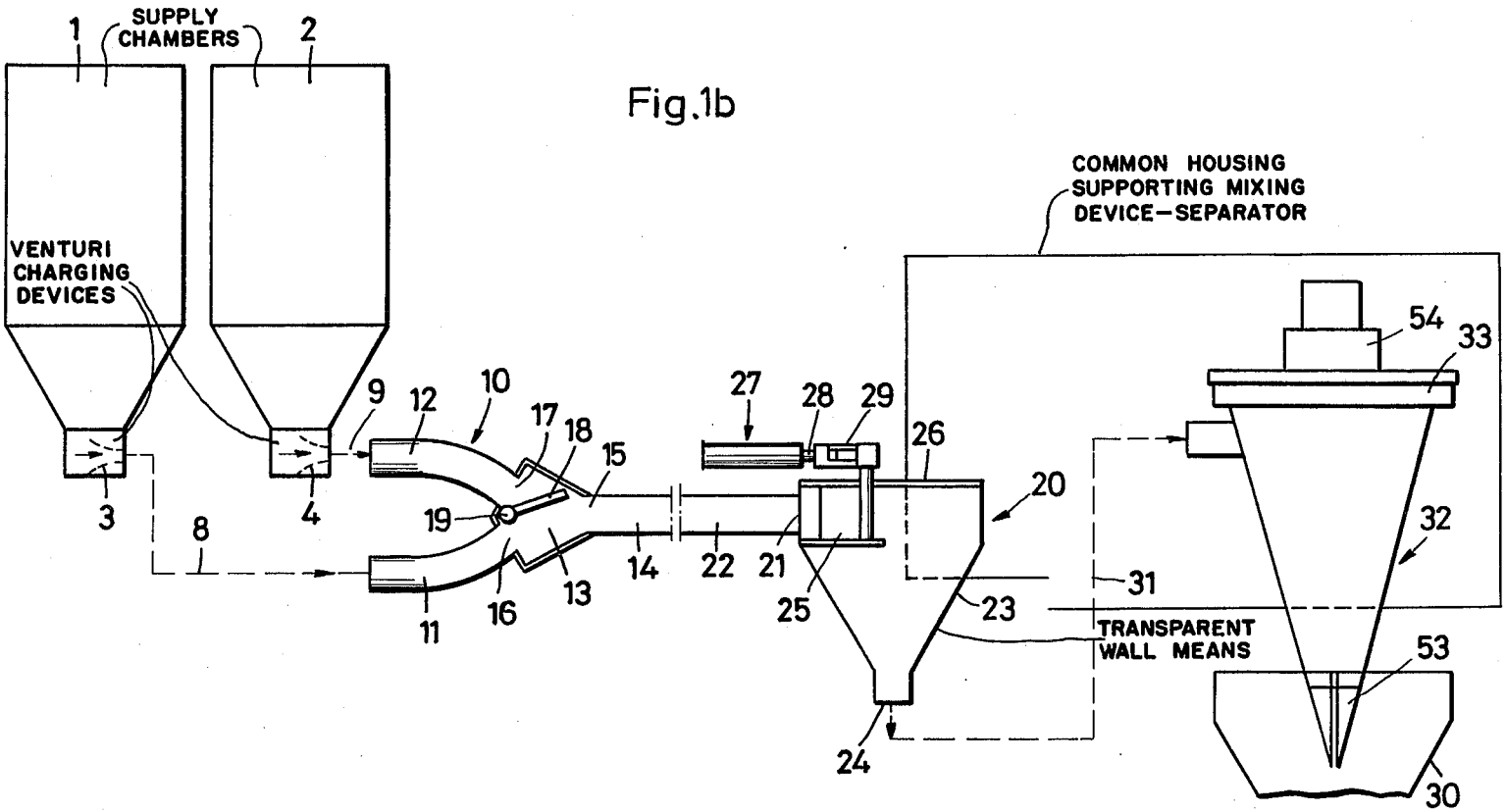

FIG. 1*b* shows a mixing device similar to that of FIG. 1*a* but operating with suction. To this end, instead of the compressed air blower 7, there is provided a suction pump 54 which, in the illustrated example, is connected to the air separator 32 and communicates with the interior of the air separator 32 by means of an air filter 33. All other parts of the device according to FIG. 1*b* correspond to similar parts of the device according to FIG. 1*a* and, therefore, have been designated with the same reference numerals as in FIG. 1*a*.

The operation of the arrangement of FIG. 1*b* corresponds substantially to the above described operation of the device of FIG. 1*a*. By drawing-in the substances stored in containers 1 and 2 by means of the suction pump 54, it will be appreciated that, merely instead of the continuous charging caused by the pressure operation, a charging of the entrance passages 11, 12 at intervals takes place and, more specifically, in conformity with the position of flap 18. This difference, however, is of no importance for the intermixing of the substances behind the flap 18 in the discharge passage 14.

Figure 2:
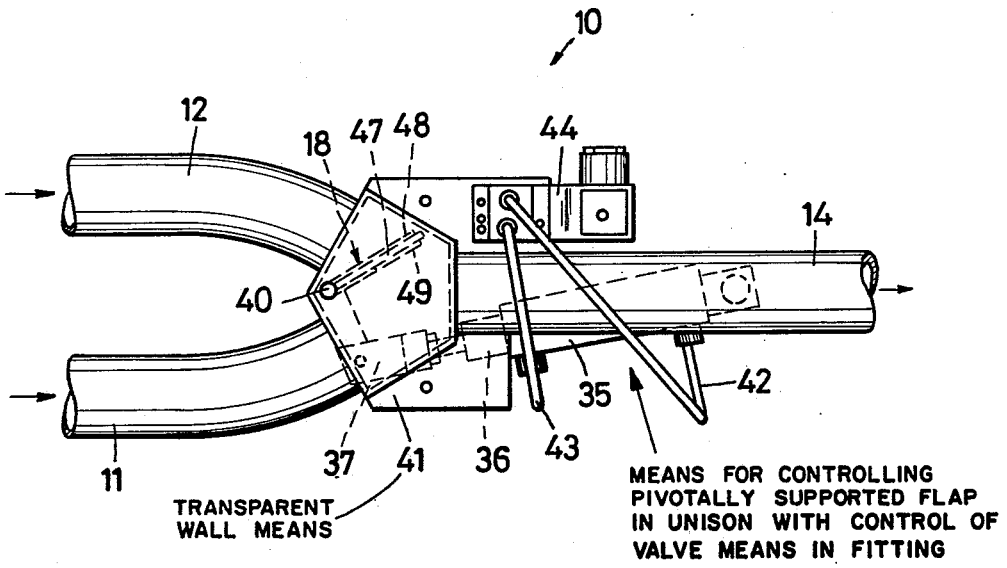
FIG. 2 is a top view of the mixing device according to FIG. 1*a*.
Figure 3:
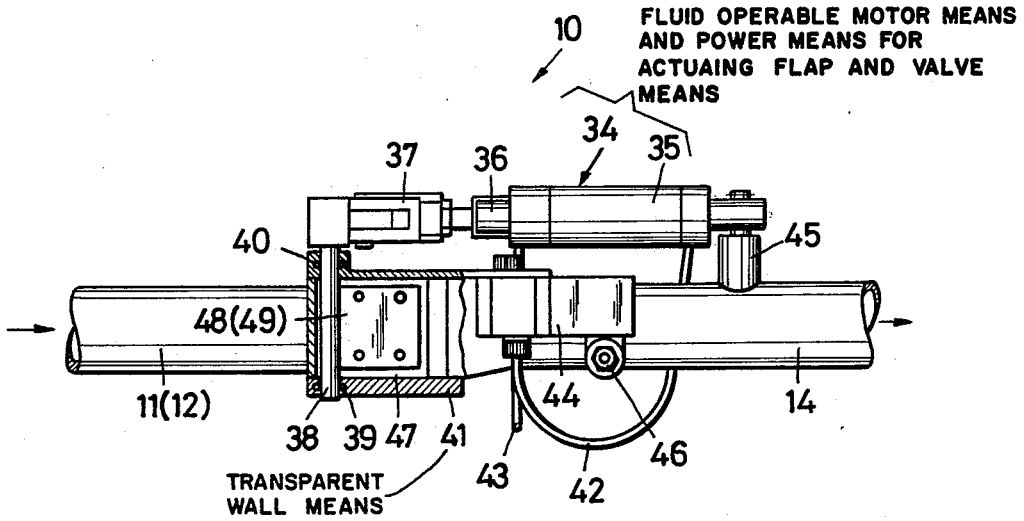
FIG. 3 is a side view of the mixing device according to FIG. 1*b*.

FIGS. 2 and 3 more clearly illustrate the first mixing device 10. As will be seen from FIGS. 2 and 3, an adjusting device 34 is connected to the flap 18. This adjusting device 34, in the illustrated embodiment, comprises a hydraulic cylinder 35, a hydraulic piston 36, and a lever linkage 37. The lever linkage 37 is connected to shaft 38 of flap 18 which by means of antifriction bearings 39, 40 is journalled on the bottom and top side of the housing 41. For reasons of saving space, sliding bearings may be used instead of antifriction bearings. Within the region of the end faces of the hydraulic cylinder 35, hydraulic control conduits 42 and 43 are connected which are acted upon by a control device 44. The hydraulic cylinder 35 and the control device 44 are connected to fixed mountings 45 and 46 of the outlet passage 14. The flap 18 comprises a core 47 of elastic material, for instance of rubber, which is held between two parallel plates 48 and 49. The elastic core 47 projects beyond the plates 48 and 49 at three lateral edges while the projecting parts of core 47 form corresponding sealing lips of flap 18. These sealing lips cushion the abutment of flap 18 which as a result thereof operates with a minimum of noise.

Figure 4:
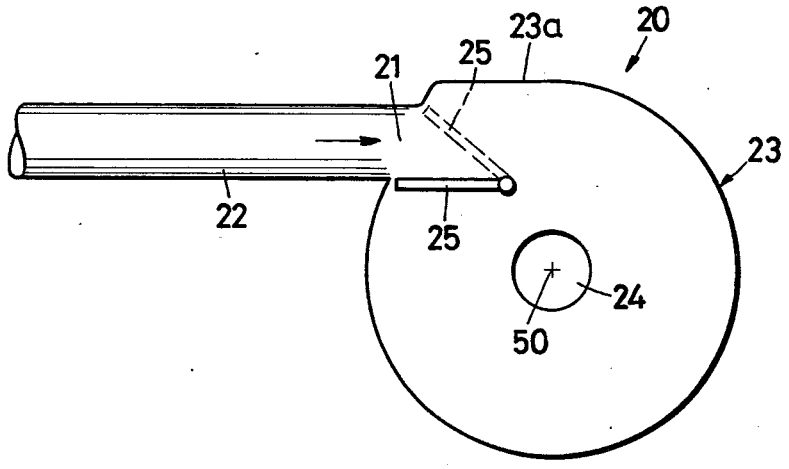
FIG. 4 is a top view of a further mixing device according to the invention which follows the mixing device according to FIGS. 1*a* and 1*b*.

The top view of FIG. 4 upon the second mixing device 20 shows the various working positions of flap 25 which may be designed in the manner of flap 18. In the position of flap 25 indicated in solid lines, the granulate entering through the opening 21 is guided substantially tangentially with regard to that section of opening 21 which is adjacent the inner wall of housing 23. Consequently the granulate is subjected to a relatively high centrifugal acceleration. As a result thereof, the granulate introduced in this position of the flap 25 is distributed already uniformly in the upper region of housing 23 and, more specifically, over the inner wall thereof. In the second position of flap 25, which is indicated by dash lines, the granulate introduced through opening 21 is deviated more in the direction toward the longitudinal axis 50 which is oriented perpendicular to the drawing plane of FIG. 4 and thus hits the inner wall of housing 23 only in the lower region of said housing. Flap 25 may be controlled synchronously or asynchronously with regard to flap 18. As a result thereof, a running ahead or a trailing of one mixing device relative to the other mixing device can be obtained. Due to the flap 25 being built-up similar to flap 18, it is possible, in addition to the already mentioned advantage of a sufficiently low noise abutment, to obtain on all sides a uniform pressure upon the sealing lips and thus a uniform seal of the respective openings 21, 16 and 17. The shift-over frequency of flaps 18 and 25 amounts to about from two to 30 shifting operations per minute.

Instead of hydraulic adjusting devices 27 and 34, electric, electrohydraulic, pneumatic, and electropneumatic adjusting devices may be provided. Furthermore, the housing 41 of the first mixing device as well as the housing 25 of the second mixing device may consist in part of transparent material, such as acrylic glass, whereby an optical surveillance of the function of the mixing devices 10 and 20 as well as the delivery of the substances to be mixed by one operator will be possible. The installation position of the mixing devices 10 and 20 does not have to be horizontal as shown in the drawings, but may also be inclined or vertical.

Furthermore, the adjusting devices 27 and 34 may be combined to a common adjusting device. Finally, it is also possible to mount the flap 25 on the wall of housing 23 adjacent the inlet opening 21. In this case the flap 25 will in its first position be located parallel to the wall section 23*a* (FIG. 4) of housing 23, whereas its second position corresponds to the position shown in FIG. 4 by dash lines.

Figure 5:
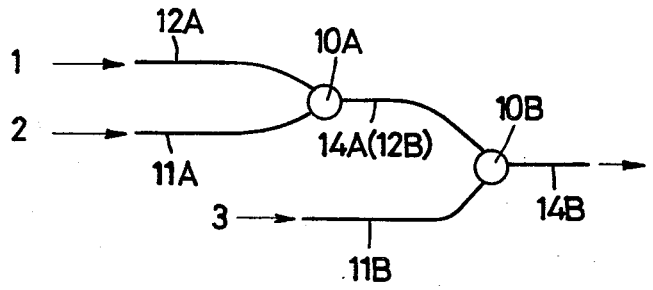
FIG. 5 is a diagrammatic illustration of two mixing devices according to FIGS. 1*a* and 1*b* which are arranged in series with regard to each other.

FIG. 5 shows an arrangement in series of two mixing devices according to FIGS. 2 and 3 for mixing three different substances, for instance granulate 1, granulate 2, and granulate 3. As will be seen from FIG. 5, the granulates 1 and 2 are conveyed to the inlet passages 12A and 11A respectively of the mixing device 10A. The granulate 3 is conveyed to the inlet passage 11B of the mixing device 10B. The outlet passage 14A of the mixing device 10A is in communication with the inlet passage 12B of the mixing device 10B so that the mixture of the granulates 1 and 2 is conveyed to the inlet passage 12B. In the mixing device 10B there will then be effected the intermixing with the granulate 3 so that the outlet passage 14*b* of the mixing device 10B feeds a mixture of all three granulates.

As will be evident from the above, the mixing device according to the invention will in structurally simple manner assure a high throughput of the substances to be intermixed with a minimum attention being required on the part of the operator. The shut-off device may be designed in a highly favorable manner. The device according to the invention may either directly or through a following further mixing device be in communication with the charging opening of a machine for further processing the mixed substances. The flaps provided with the mixing device according to the invention or an additional mixing device can advantageously be controlled.

It is, of course, to be understood that the present invention is, by no means, limited to the specific showing in the drawings, but also comprises any modifications within the scope of the appended claims.

What is claimed is:

1. In a device for mixing flowable materials, especially dry materials, comprising; at least a pair of supply conduits each adapted to convey a respective material, a discharge conduit, a fitting connected to the downstream ends of said supply conduits and to the upstream end of said discharge conduit, valve means selectively operable for closing off either one of the discharge ends of said supply conduits, and means for supplying materials to the supply conduits under control of the valve means positioned alternately to block and to permit discharge of material from the respective conduit.

2. A device according to claim 1 in which said valve means comprises a flap valve pivotally supported in said fitting and moveable into position to interrupt the discharge from either one of said supply conduits into said fitting.

3. A device according to claim 2 in which said flap valve has an elastic peripheral portion.

4. A device according to claim 1 in which said valve means is a flap valve pivotally supported in said fitting on an axis located within the fitting near the points of entrance therein of said supply conduits.

5. A device according to claim 1 in which at least said fitting has transparent wall means.

6. In a device for mixing flowable materials, especially dry materials, comprising; at least a pair of supply conduits each adapted to convey a respective material, a discharge conduit, a fitting connected to the downstream ends of said supply conduits and to the upstream end of said discharge conduit, valve means selectively operable for closing off either one of the discharge ends of said supply conduits, and a secondary mixing device connected to the downstream end of said discharge conduit.

7. A device according to claim 6 in which said secondary mixing device is also operable to separate air from the materials flowing into said secondary mixing device from said discharge conduit.

8. A device according to claim 6 which includes an air separator connected to the downstream side of said secondary mixing device.

9. A device according to claim 6 which includes a flexible coupling member forming the downstream portion of said discharge conduit and connected to said secondary mixing device.

10. A device according to claim 6 in which said secondary mixing device comprises a cyclone having a tangential inlet near one end and an axial outlet at the other end, and an adjustable guide means in the cyclone near the said inlet for controlling the movement of the materials entering the cyclone.

11. A device according to claim 10 in which said guide means is a pivotally supported flap.

12. A device according to claim 10 which includes means for controlling said pivotally supported flap independently of the control of said valve means in said fitting.

13. A device according to claim 10 which includes means for controlling said pivotally supported flap in unison with the control of said valve means in said fitting.

14. A device according to claim 10 which includes power means for actuating said flap and said valve means.

15. A device according to claim 14 in which said power means includes fluid operable motor means.

16. A device according to claim 6 which includes a common housing supporting said mixing device.

17. In a device for mixing flowable materials, especially dry materials, comprising; at least a pair of supply conduits each adapted to convey a respective material, a discharge conduit, a fitting connected to the downstream ends of said supply conduits and to the upstream end of said discharge conduit, valve means selectively operable for closing off either one of the discharge ends of said supply conduits, and a further mixing device having said discharge conduit as one supply conduit and a further conduit as the second supply conduit.

18. In a device for mixing flowable materials, especially dry materials, comprising; at least a pair of supply conduits each adapted to convey a respective material, a discharge conduit, a fitting connected to the downstream ends of said supply conduits and to the upstream end of said discharge conduit, valve means selectively operable for closing off either one of the discharge ends of said supply conduits, respective supply chambers at the upstream ends of said supply conduits, and venturi charging devices connecting each chamber with the respective supply conduits.

19. A device according to claim 18 which includes supplying air to the upstream ends of said supply conduits to convey material therealong.

20. A device according to claim 18 which includes withdrawing air from the downstream ends of said supply conduits to convey material therealong.

* * * * *